US006832814B2

(12) United States Patent
Stenzel et al.

(10) Patent No.: US 6,832,814 B2
(45) Date of Patent: Dec. 21, 2004

(54) CHAIR WITH ADJUSTABLE SEAT DEPTH

(75) Inventors: Thomas Stenzel, Waldshut (DE); Michael Klaesener, Waldshut (DE)

(73) Assignee: Sedus Stoll AG, Waldshut-Tiengen (DE)

( * ) Notice: Subject to any disclaimer, the term of this patent is extended or adjusted under 35 U.S.C. 154(b) by 0 days.

(21) Appl. No.: 10/619,611

(22) Filed: Jul. 16, 2003

(65) Prior Publication Data

US 2004/0070249 A1 Apr. 15, 2004

(30) Foreign Application Priority Data

Aug. 23, 2002 (EP) ..... 02018848

(51) Int. Cl.[7] ..... A47C 1/023
(52) U.S. Cl. ..... 297/337
(58) Field of Search ..... 297/337, 317, 297/318, 344.1; 108/137, 143, 102

(56) References Cited

U.S. PATENT DOCUMENTS

| | | | | | |
|---|---|---|---|---|---|
| 3,982,785 | A | | 9/1976 | Ambasz | 297/337 |
| 5,035,466 | A | | 7/1991 | Mathews et al. | 297/337 |
| 5,380,062 | A | * | 1/1995 | Nania | 297/329 |
| 5,755,488 | A | * | 5/1998 | Beda et al. | 297/337 |
| 6,027,168 | A | * | 2/2000 | Crossman et al. | 297/337 |
| 6,193,313 | B1 | * | 2/2001 | Jonsson | 297/284.1 |
| 6,634,711 | B2 | * | 10/2003 | Phillips et al. | 297/337 |
| 6,767,062 | B2 | * | 7/2004 | Piretti | 297/337 |
| 2002/0180248 | A1 | * | 12/2002 | Kinoshita et al. | 297/284.1 |
| 2003/0067200 | A1 | * | 4/2003 | Habermann et al. | 297/337 |

FOREIGN PATENT DOCUMENTS

| | | |
|---|---|---|
| DE | 100 48 898 | 5/2002 |
| JP | 2002-136376 | 5/2002 |

* cited by examiner

*Primary Examiner*—Peter R. Brown
(74) *Attorney, Agent, or Firm*—Oblon, Spivak, McClelland, Maier & Neustadt, P.C.

(57) ABSTRACT

In the case of a chair with adjustable seat depth, the seat comprises a rigid supporting panel (1) and a single-piece, longitudinally flexible seat panel (2) which bears the seat cushion (3) and is connected in a longitudinally displaceable manner to the supporting panel (1). The longitudinal displaceability is achieved by providing guide strips (6) mounted in guideways (4) on the top side of the seat panel (2), the guide strips being fastened on the supporting panel (1) via screws (7), and the screws (7) passing through slots (5) on the base of the guideways (4). The supporting panel (1) is advantageously designed as a frame and consists of cast aluminium, and the seat panel (2) consists of polypropylene. This achieves an optimum sliding pairing.

8 Claims, 5 Drawing Sheets

CHAIR WITH ADJUSTABLE SEAT DEPTH

TECHNICAL FIELD

The invention relates to the field of seating furniture, in particular to a chair with adjustable seat depth, preferably for the office.

PRIOR ART

Different technical solutions for chairs which allow the user to adapt the seat depth, that is to say the horizontal spacing of the seat from the backrest, to his/her requirements are known.

For example, DE 100 48 898 A1 discloses a chair in the case of which the seat comprises a rigid seat-supporting panel and a deformable seat-cushion panel which has a flexible region and can be displaced on the seat-supporting panel. The seat-cushion panel consists of plastic and can be deformed to a particularly pronounced extent in its flexible region on account of a special interrupted contour.

Although this solution has proven successful in principle, it still involves too much outlay to produce, and the sliding property of the seat-cushion panel on the seat-supporting panel is still capable of improvement.

DESCRIPTION OF THE INVENTION

The object of the invention is thus to develop a chair with adjustable seat depth further such that it is straightforward and thus cost-effective to produce and assemble but nevertheless, in respect of seat-depth adjustment, provides optimum comfort for the user.

This object is achieved by the features of claim 1 and of the subclaims.

The invention is based on the idea of co-ordinating the supporting panel and the seat panel in terms of design, shape and material such that they can be straightforwardly assembled, using only a small number of means, but then nevertheless slide optimally one upon the other during use. It is particularly advantageous in this context for the supporting panel to be designed as frame of diecast aluminium and for the seat panel to be designed as a single-piece plastic part, preferably of polypropylene, with a thickness of approximately 5 mm in the main part and a thickness of approximately 1.5 mm in the guideways and transverse grooves.

BRIEF DESCRIPTION OF THE DRAWINGS

The invention is explained in more detail hereinbelow with reference to an exemplary embodiment illustrated in the drawings, in which.

METHODS OF IMPLEMENTING THE INVENTION

Figure 1:
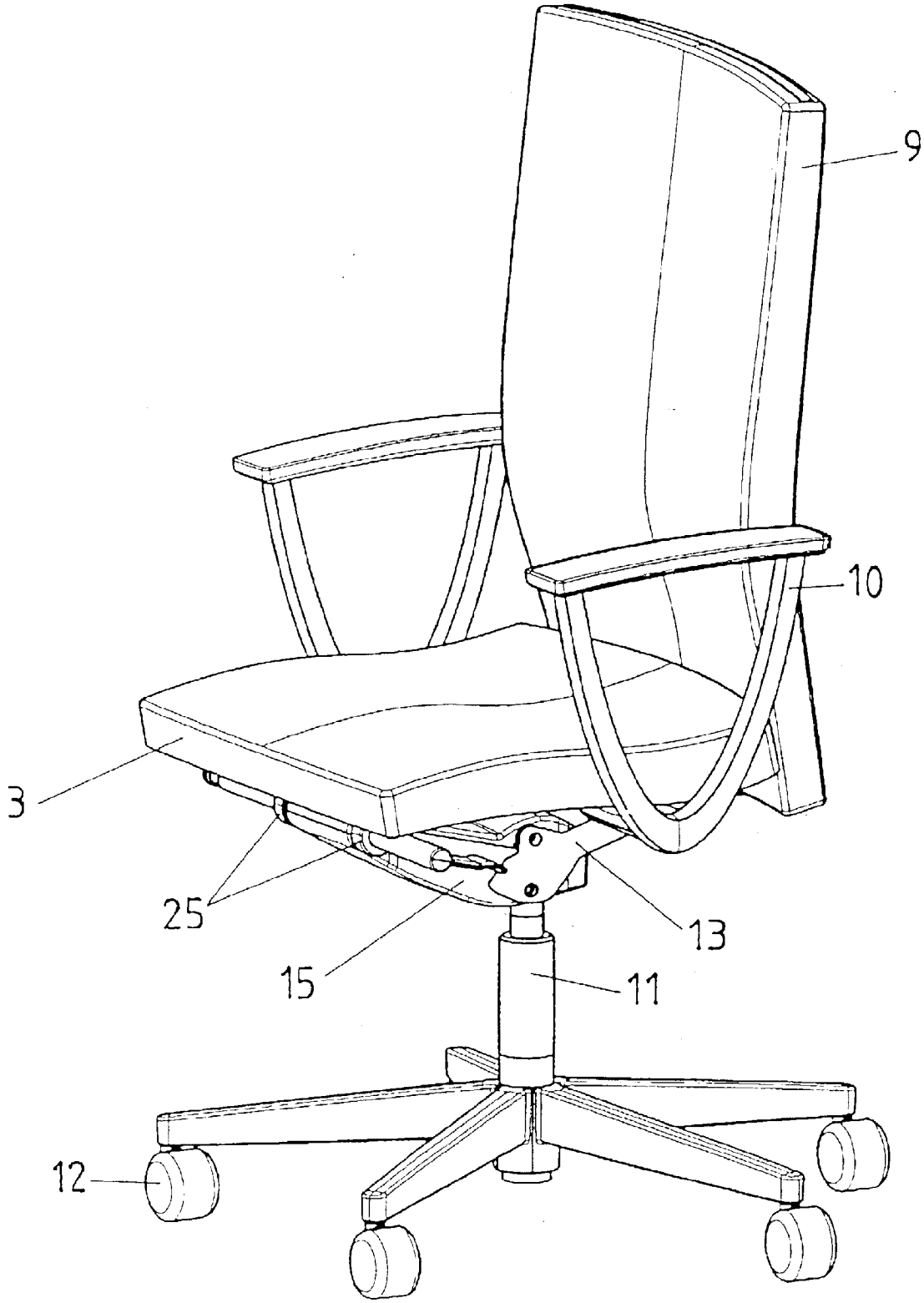
FIG. 1 shows the illustration of a complete chair with a seat configured according to the invention.
Figure 2:
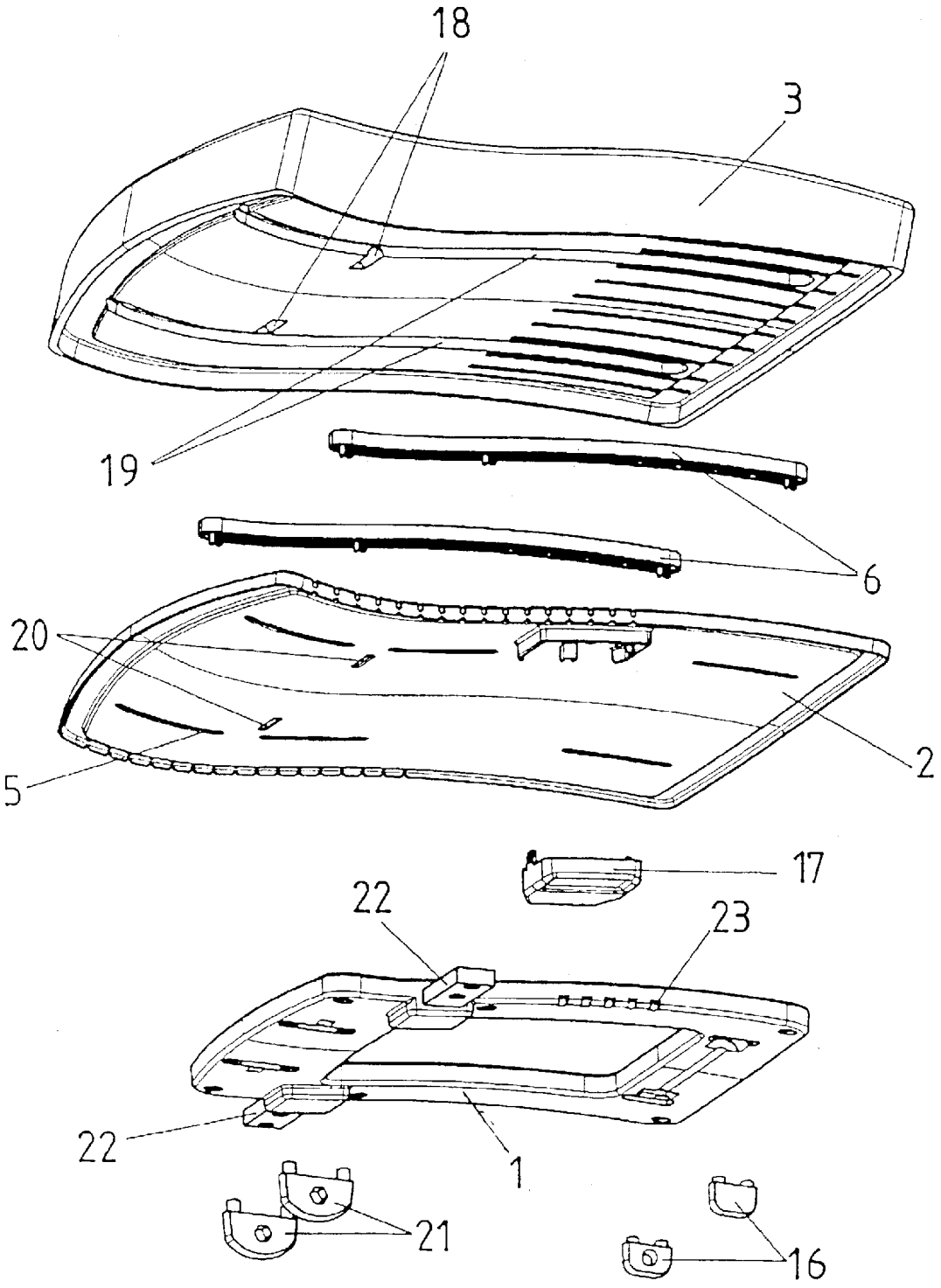
FIG. 2 shows the view of the seat in an exploded illustration from beneath.
Figure 3:
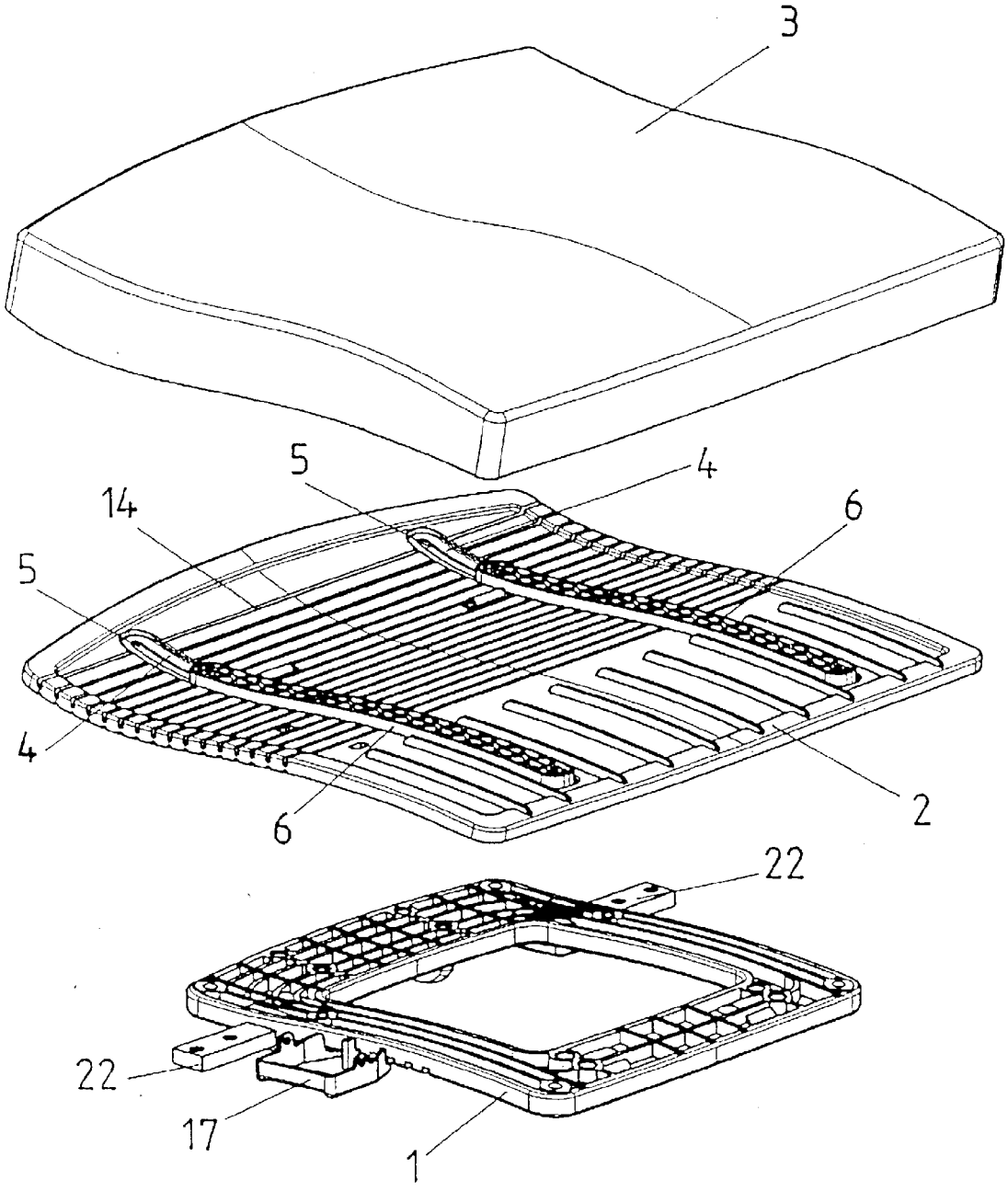
FIG. 3 shows the view of the seat in an exploded illustration from above.
Figure 4:
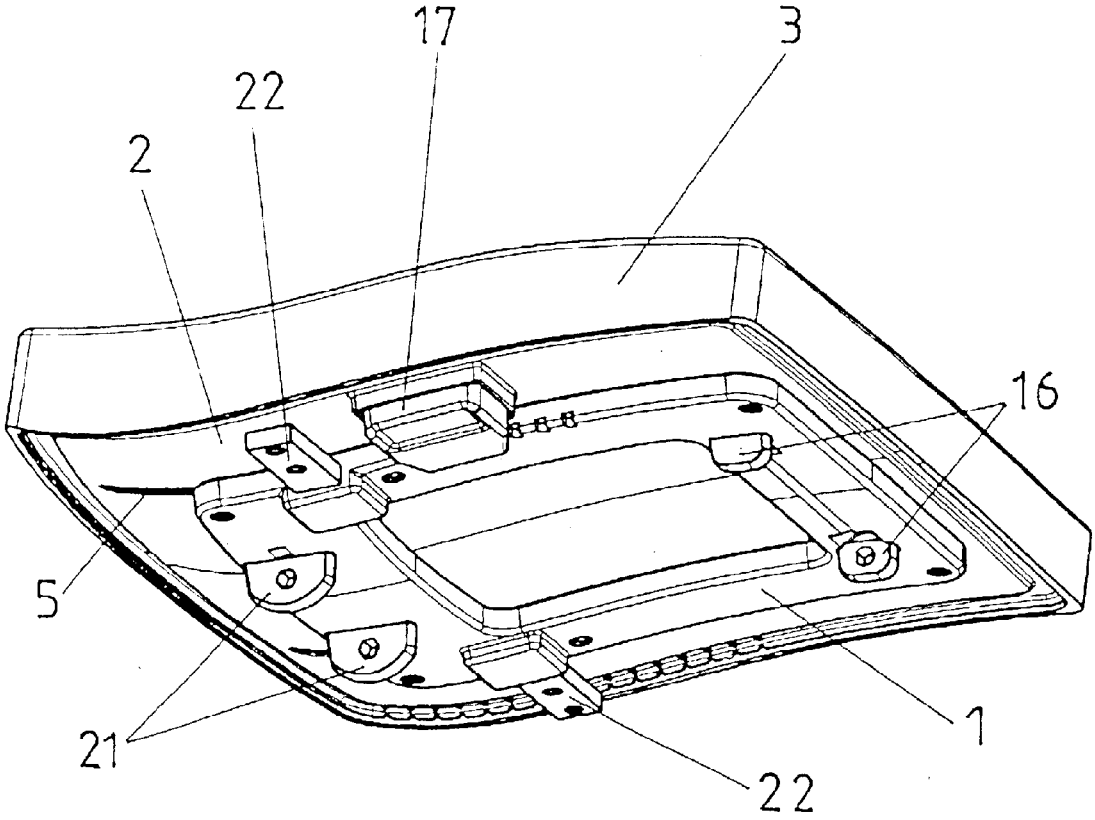
FIG. 4 shows the assembled seat in a view from beneath.
Figure 5:
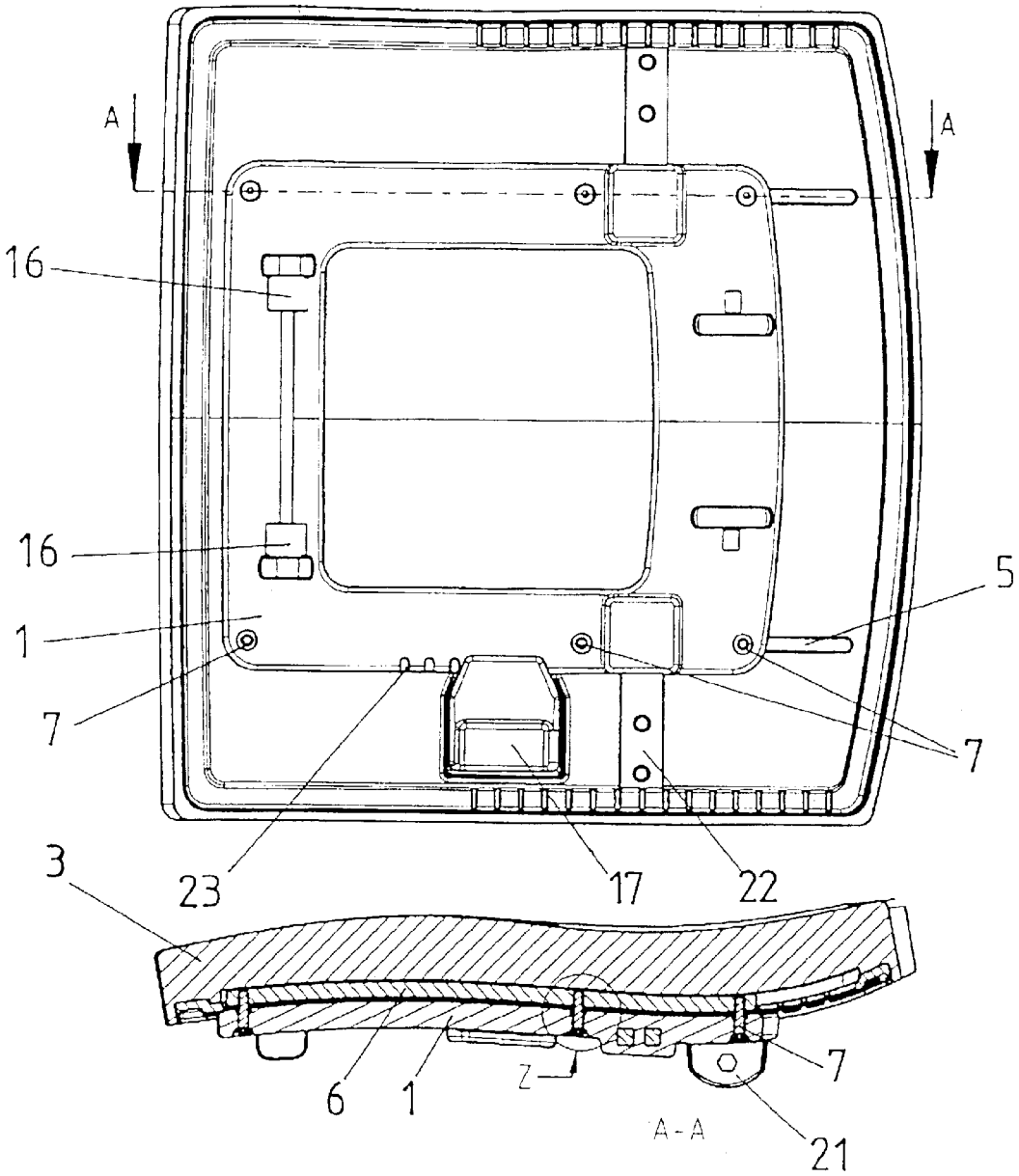
FIG. 5 shows the assembled seat from beneath, a section through the assembled seat in side view, and a detail thereof.
Figure 5:
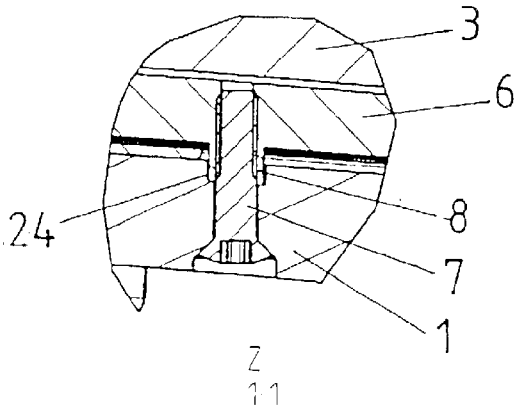

FIG. 1 illustrates an office chair which comprises a seat cushion 3, a backrest 9 and armrests 10, which are arranged on a stand 11 with the casters 12 at the bottom. In its front part, the seat is mounted on a supporting arm 15 in a conventional manner via the rocker bearings 25. It is also the case that the backrest support 13 is mounted on this supporting arm 15, which contains the seat mechanics.

The seat according to the invention is illustrated in detail in FIGS. 2–5:

It comprises, as essential constituent parts, the supporting panel 1, which is designed as a frame and consists of diecast aluminium, the seat panel 2 and the seat cushion 3. The seat panel 2 is flexible in the longitudinal direction. It consists of polypropylene and, in the main part, has a thickness of approximately 5 mm. For the purpose of increasing the flexibility of the seat panel 2 in the longitudinal direction, transverse grooves 14 with a material thickness of approximately 1.5 mm are provided in the region of greatest deformation. The supporting panel 1, the seat panel 2 and the seat cushion 3 have a curved surface contour, this producing a seat hollow with front convex curvature and rear pelvic-brim support.

Provided on the top surface of the seat panel 2 are two laterally arranged, longitudinally running guideways 4, which have a guide slot 5 at the bottom. The material in the guideways 4 has a thickness of approximately 1.5 mm. Guide strips 6 are mounted in the guideways 4.

The guide strips 6 each have three screw-connection sleeves 8 which pass through the guide slots 5 and enter into bores 24 of the supporting panel 1. The supporting panel 1 can thus be screwed to the guide strips 6 via the seat screws 7, as can be seen particularly clearly from FIG. 5.

The figures also illustrate the following details:

On an outer edge, the supporting panel 1 has notches 23, in which a spring-loaded arresting button 17 engages by means of a nose. Also fitted on the supporting panel 1 are lateral arm rest supports 22, on which the arm rests 10 are fastened.

On its underside, the seat cushion 3 has longitudinal channels 19, in which the guide strips 6 engage. Also provided there are recesses 18, in which protrusions 20 of the seat panel 2 engage during assembly.

The fastening of the seat on the supporting arm 15 of the stand 11 takes place above the rocker bearings 25, via the seat bearings 16. The backrest support 13 is articulated on the bearings 21.

The seat according to the invention functions such that, following release of the arresting button 17, the user can move the seat cushion 3 in the forward or rearward direction by subjecting it to a force parallel to the surface. In this case, the seat panel 2 slides forwards or rearwards on the supporting panel 1 and is guided by means of the guide strips 6 mounted in the guideways 4. The particular advantage of the invention is that the seat panel 2 slides on the stationary, contoured supporting panel 1 and the seat hollow thus remains at the same location, irrespective of the seat depth set.

| List of Designations | |
|---|---|
| 1 | Supporting panel |
| 2 | Seat panel |
| 3 | Seat cushion |
| 4 | Guideway |
| 5 | Guide slot |
| 6 | Guide strip |

-continued

| List of Designations | |
|---|---|
| 7 | Seat screw |
| 8 | Screw-connection sleeve |
| 9 | Backrest |
| 10 | Armrest |
| 11 | Stand |
| 12 | Casters |
| 13 | Backrest support |
| 14 | Transverse grooves |
| 15 | Supporting arm |
| 16 | Seat bearing |
| 17 | Arresting button |
| 18 | Recesses |
| 19 | Longitudinal channel |
| 20 | Protrusions |
| 21 | Bearings for backrest support |
| 22 | Armrest supports |
| 23 | Notches |
| 24 | Bores |
| 25 | Rocker bearings |

What is claimed is:

1. Chair with adjustable seat depth, the seat of the chair comprising a rigid supporting panel (1) and a displaceable and deformable seat panel (2) with a seat cushion (3), characterized in that the seat panel (2) comprises a single-piece, longitudinally flexible plastic panel which rests on the supporting panel (1), and the seat panel (2) has, on its top side, at least one guideway (4) in which a guide strip (6) is mounted, the guide strip being connected to the supporting panel (1) by way of a guide slot (5).

2. Chair according to claim 1, characterized in that the guide strip (6) has screw-connection sleeves (8) in which the supporting panel (1) is fastened by means of screws (7).

3. Chair according to claim 1, characterized in that the seat panel (2), for the purpose of increasing its flexibility, has transverse grooves (14) in the region of greatest deformation and consists of polypropylene with a thickness of approximately 5 mm, which is reduced to approximately 1.5 mm in the guideways (4) and in the transverse grooves (14), and in that the supporting panel (1) is of frame-like design and consists of cast aluminium.

4. Chair according to claim 1, characterized in that the seat cushion (3), on its underside, has at least one longitudinal channel (19), in which the guide strip (6) of the seat panel (2) engages, and recesses (18), in which protrusions (20) of the seat panel (2) engage.

5. Chair according to claim 1, characterized in that notches (23) are provided on one side of the supporting panel (1), the nose of a spring-loaded arresting button (17) engaging in said notches.

6. Chair according to claim 1, characterized in that in each case one armrest support (22) is provided on the two longitudinal sides of the supporting panel (1).

7. Chair according to claim 1, characterized in that the supporting panel (1) is curved on its top side to produce a seat hollow in the backrest-end part of the seat.

8. Chair according to claim 1, characterized in that a flat part with a low coefficient of friction, for example a plastic plate or sheet, is provided between the supporting panel (1) and the seat panel (2), at least in the region of the frame of the supporting panel (1), for the purpose of increasing the sliding capability.

* * * * *